US008596509B2

(12) United States Patent
Kim et al.

(10) Patent No.: US 8,596,509 B2
(45) Date of Patent: Dec. 3, 2013

(54) HIGH SPEED AND FINE SUBSTRATE ALIGNMENT APPARATUS IN ROLL TO ROLL SYSTEM

(75) Inventors: Dong Min Kim, Suwon-si (KR); Sin Kwon, Suwon-si (KR); Young Tae Cho, Suwon-si (KR); Jung Woo Seo, Hwaseong-si (KR); Ki Keon Yeom, Suwon-si (KR); Ki Hyun Kim, Yongin-si (KR)

(73) Assignee: Samsung Electronics Co., Ltd., Gyeonggi-do (KR)

( * ) Notice: Subject to any disclaimer, the term of this patent is extended or adjusted under 35 U.S.C. 154(b) by 1026 days.

(21) Appl. No.: 12/461,061

(22) Filed: Jul. 30, 2009

(65) Prior Publication Data

US 2010/0072245 A1 Mar. 25, 2010

(30) Foreign Application Priority Data

Sep. 23, 2008 (KR) ..... 10-2008-0093180

(51) Int. Cl.
*B65H 23/038* (2006.01)
*B65H 23/192* (2006.01)
*B65H 27/00* (2006.01)

(52) U.S. Cl.
USPC ..... 226/178; 226/16; 226/19; 226/21; 226/31; 226/179; 226/194

(58) Field of Classification Search
USPC ..... 226/2, 3, 16, 19–23, 27, 31, 124, 178, 226/179, 180, 188, 190, 194
See application file for complete search history.

(56) References Cited

U.S. PATENT DOCUMENTS

| | | | | | |
|---|---|---|---|---|---|
| 2,593,158 | A | * | 4/1952 | Lorig | 226/192 |
| 2,850,277 | A | * | 9/1958 | Clark | 226/18 |
| 3,095,131 | A | * | 6/1963 | Robertson et al. | 226/190 |
| 3,117,462 | A | * | 1/1964 | Davis | 474/104 |
| 3,743,195 | A | * | 7/1973 | Bagdasarian | 242/364.2 |
| 5,081,488 | A | * | 1/1992 | Suzuki | 399/303 |
| 5,246,099 | A | * | 9/1993 | Genovese | 198/807 |
| 5,441,190 | A | * | 8/1995 | Goodwin | 226/18 |
| 5,659,851 | A | * | 8/1997 | Moe et al. | 399/165 |
| 6,098,863 | A | * | 8/2000 | Hevenor et al. | 226/15 |

FOREIGN PATENT DOCUMENTS

| | | |
|---|---|---|
| JP | 55-007110 | 1/1980 |
| KR | 10-1999-0016859 | 3/1999 |

OTHER PUBLICATIONS

Japanese Office Action dated May 28, 2013, for corresponding Japanese Patent Application No. 2009-191851.

* cited by examiner

*Primary Examiner* — Sang Kim
*Assistant Examiner* — Scott Haugland
(74) *Attorney, Agent, or Firm* — Harness, Dickey & Pierce P.L.C.

(57) ABSTRACT

Disclosed is a substrate alignment apparatus capable of performing coarse and fine alignments of a substrate in a progressing route to remove or reduce an alignment error between the substrate and a pattern roll. The coarse alignment may be performed by moving a frame using a stage when the alignment error is relatively large, and the fine alignment may be performed by moving subsidiary rollers of a roller unit relative to a main roller of a roller unit when the alignment error is relatively small. An example substrate alignment apparatus may include a frame and a roller unit rotatably fixed to the frame to support a substrate, wherein the roller unit includes a main roller, and at least one subsidiary roller fixed to the main roller such that the at least one subsidiary roller can move relative to the main roller to align the substrate.

12 Claims, 13 Drawing Sheets

HIGH SPEED AND FINE SUBSTRATE ALIGNMENT APPARATUS IN ROLL TO ROLL SYSTEM

CROSS-REFERENCE TO RELATED APPLICATION(S)

This application claims priority under 35 U.S.C. §119 to Korean Patent Application No. 10-2008-0093180, filed on Sep. 23, 2008, in the Korean Intellectual Property Office (KIPO), the entire contents of which are herein incorporated by reference.

BACKGROUND

1. Field

The general inventive concept relates to a substrate alignment apparatus, and more particularly, to a substrate alignment apparatus, which may finely remove an alignment error between a substrate and a roll at a relatively high speed.

2. Description of the Related Art

A roll to roll process is a process in which a material, wound on a roll, is processed. Roll to roll processing is applied in various printing industries. For example, newspapers are commonly produced using a roll to roll printing technique. As another example, roll to roll processing is used in the production of wrapping paper. For color wrapping paper, the wrapping paper is printed with the colors using several pattern rolls. Printing alignment accuracy required between the wrapping paper and each of the pattern rolls may not be less than about 0.1 mm.

A roll to roll process may allow a flexible substrate, for example, a wrapping paper or a newspaper, to continuously pass through a gap between rolls, and may be capable of achieving relatively high-speed production. Accordingly, the roll to roll process may be applied as a new generation process technique. However, because the substrate may, at times, be unsupported during a roll to roll fabrication process, the roll to roll process technique may be vulnerable to disturbance. Further, because the flexible substrate may be used, an alignment error may be generated due to a variation of the length of the substrate when the tensile force is not uniform. This alignment error may be relatively large, and thus, the roll to roll process may not be easily applied to a liquid crystal display (LCD), an organic light emitting diode (OLED), an organic thin film transistor (OTFT), a plasma display panel (PDP), and/or a solar cell.

SUMMARY

One aspect of the general inventive concept is to provide a substrate alignment apparatus, which may finely remove an alignment error between a substrate and a roll at a high speed using piezoelectric elements.

In accordance with an example embodiment of the present invention, a substrate alignment apparatus may include a frame and a roller unit rotatably fixed to the frame to support a substrate, wherein the roller unit includes a main roller, and at least one subsidiary roller fixed to the main roller. The at least one subsidiary roller may be fixed to the main roller such that the at least one subsidiary roller may move relative to the main roller to align the substrate.

In accordance with an example embodiment of the present invention, a substrate alignment apparatus may include a frame located in a progressing route of a substrate. The alignment apparatus may include a main roller rotatably fixed to the frame, subsidiary rollers fixed to the main roller to support the substrate, and variable devices disposed between the main roller and the subsidiary rollers to move the subsidiary rollers relative to the main roller. In accordance with the example embodiment of the present invention, the variable devices may include first variable devices pressing the subsidiary rollers in the progressing direction of the substrate, and second variable devices pressing the subsidiary rollers in a direction crossing the progressing direction of the substrate.

In accordance with an example embodiment of the present invention, a roll to roll process system may include a substrate, a pattern roll to form a pattern on the substrate, and a substrate alignment apparatus to align the substrate and the pattern roll. The substrate alignment apparatus may include a main roller at the front of the pattern roll and subsidiary rollers fixed to the main roller such that the subsidiary rollers may move relative to the main roller.

In accordance with one aspect of the present invention, the general inventive concept provides a substrate alignment apparatus including a frame and a roller unit rotatably fixed to the frame to support a substrate, wherein the roller unit includes a main roller, and subsidiary rollers fixed to the main roller such that the subsidiary rollers may move relative to the main roller to align the substrate.

The substrate alignment apparatus may further comprise variable devices disposed between the main roller and the subsidiary rollers to move the subsidiary rollers relative to the main roller.

The variable devices may include first variable devices respectively pressing the subsidiary rollers in a direction crossing the longitudinal direction of the main roller, and second variable devices pressing the subsidiary rollers in the longitudinal direction of the main roller.

Each of the first variable devices may include first pressure members connected to the main roller, second pressure members connected to each of the subsidiary rollers, and first variable members respectively connecting the first pressure members and the second pressure members, and the length of the first variable members may be varied in the direction crossing the longitudinal direction of the main roller.

Each of the first variable members may include a piezoelectric element.

Each of the second pressure members may include indentations such that the second pressure members may be bent in the longitudinal direction of the main roller.

Each of the second pressure members may include a plate spring such that the second pressure members may be bent in the longitudinal direction of the main roller.

Each of the second variable devices may include third pressure members connected to the main roller, fourth pressure members connected to each of the subsidiary rollers, and second variable members respectively connecting the third pressure members and the fourth pressure members, and the length of the second variable members may be varied in the longitudinal direction of the main roller.

Each of the second variable members may include a piezoelectric element.

Each of the second variable members may include a piezoelectric element and an amplifier to amplify a variation of the length of the piezoelectric element.

Each of the fourth pressure members may include indentations such that the fourth pressure members can be bent in the direction crossing the longitudinal direction of the main roller.

Each of the fourth pressure members may include a plate spring such that the fourth pressure members can be bent in the direction crossing the longitudinal direction of the main roller.

A plurality of the subsidiary rollers may be installed in the longitudinal direction of the main roller, and may be fixed to the main roller such that each of the plurality of the subsidiary rollers can move relative to the main roller.

The substrate alignment apparatus may further comprise variable devices to move at least one of the plurality of the subsidiary rollers relative to the main roller.

The substrate alignment apparatus may further comprise a stage to move the frame in the progressing direction of the substrate or a direction crossing the progressing direction of the substrate or rotate the frame.

In accordance with another example embodiment of the present invention, the general inventive concept provides a substrate alignment apparatus comprising a substrate alignment apparatus including a frame located in the progressing route of a substrate, a main roller rotatably fixed to the frame, subsidiary rollers fixed to the main roller to support the substrate, and variable devices disposed between the main roller and the subsidiary rollers to move the subsidiary rollers relative to the main roller. The variable devices may include first variable devices pressing the subsidiary roller in the progressing direction of the substrate, and second variable devices respectively pressing the subsidiary roller in a direction crossing the progressing direction of the substrate.

Each of the first variable devices may include first variable members supported between the main roller and each of the subsidiary rollers, and the length of the first variable members may be expanded and contracted in the progressing direction of the substrate.

Each of the second variable devices may include second variable members supported between the main roller and each of the subsidiary rollers, and the length of the second variable members may be expanded and contracted in the direction crossing the progressing direction of the substrate.

In accordance with yet another example embodiment of the present invention, the general inventive concept provides a roll to roll process system including a substrate, a pattern roll to form a pattern on the substrate, and a substrate alignment apparatus to align the substrate and the pattern roll, wherein the substrate alignment apparatus includes a main roller installed at the front of the pattern roll, and subsidiary rollers fixed to the main roller such that the subsidiary rollers can move relative to the main roller.

BRIEF DESCRIPTION OF THE DRAWINGS

These and/or other aspects and advantages of the general inventive concept will become apparent and more readily appreciated from the following description of the embodiments, taken in conjunction with the accompanying drawings in which.

DETAILED DESCRIPTION

Figure 1:
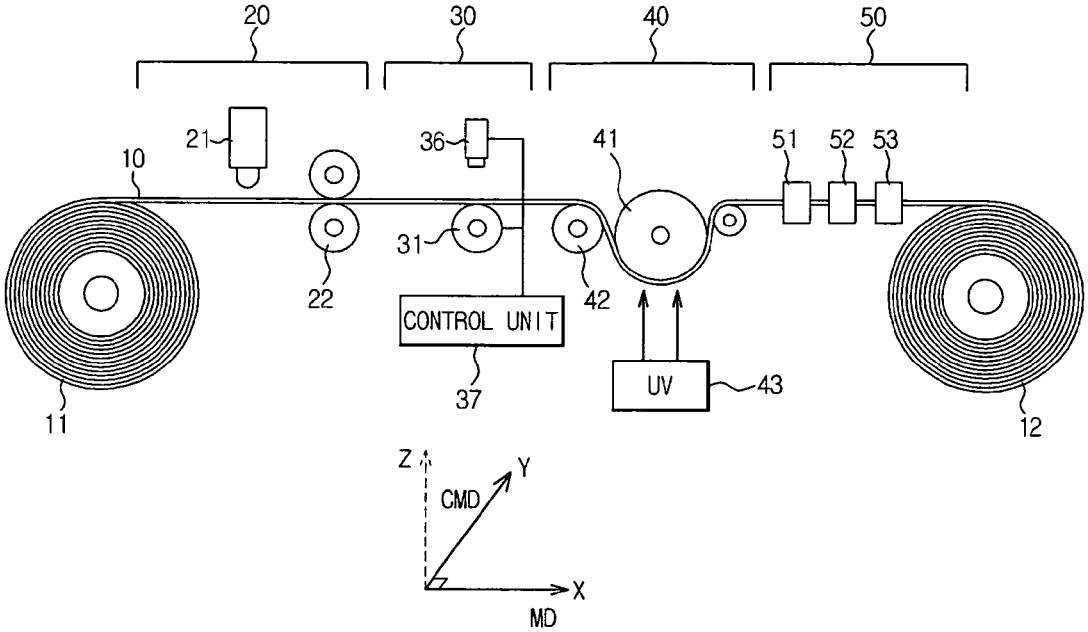
FIG. 1 is a schematic view illustrating a roll to roll process in accordance with an example embodiment of the present invention.

Reference will now be made in detail to an example embodiment of the present invention, the example being illustrated in the accompanying drawings, wherein like reference numerals refer to like elements throughout. The example embodiment is described below to explain the general inventive concept by referring to the annexed drawings.

The general inventive concept may, however, be embodied in different forms and should not be construed as limited to the example embodiment set forth herein. Rather, the example embodiment is provided so that this disclosure will be thorough and complete, and will fully convey the scope of the general inventive concept to those skilled in the art. In the drawings, the sizes of components may be exaggerated for clarity.

It will be understood that when an element or layer is referred to as being "on", "connected to", or "coupled to" another element or layer, it can be directly on, connected to, or coupled to the other element or layer or intervening elements or layers that may be present. In contrast, when an element is referred to as being "directly on", "directly connected to", or "directly coupled to" another element or layer, there are no intervening elements or layers present. As used herein, the term "and/or" includes any and all combinations of one or more of the associated listed items.

It will be understood that, although the terms first, second, etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section. Thus, a first element, component, region, layer, or section discussed below could be termed a second element, component, region, layer, or section without departing from the teachings of example embodiments.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

Example embodiments described herein will refer to plan views and/or cross-sectional views by way of ideal schematic views. Accordingly, the views may be modified depending on manufacturing technologies and/or tolerances. Therefore, the general inventive concept is not limited to example embodiments shown in the views, but may include modifications in configuration formed on the basis of manufacturing processes. Therefore, regions exemplified in figures have schematic properties and shapes of regions shown in figures exemplify specific shapes or regions of elements, and do not limit the general inventive concept.

FIG. 1 is a schematic view illustrating a roll to roll process in accordance with an example embodiment of the present invention.

As shown in FIG. 1, a substrate 10 may be continuously processed along a progressing route using the roll to roll process in accordance with the example embodiment of the present invention. Because the continuous process is carried out using a single apparatus, high-speed production may be possible. A plurality of process stages may be provided in a transfer route of the substrate 10 in order to perform the process. For example, in the transfer route from an unwinding roll 11 to a winding roll 12 (the progressing route), the process stages using a photosensitive layer forming unit 20, an aligning unit 30, a nano-imprinting unit 40, and a removing unit 50 may be sequentially provided.

The photosensitive layer forming unit 20 may apply a liquid photosensitive material to the substrate 10 to form a photosensitive layer on the substrate 10. For example, the photosensitive layer forming unit 20 may include an applying unit 21 and a coating roll 22. The applying unit 21 may apply a liquid photosensitive resin to the substrate 10, and the coating roll 22 may coat the applied photosensitive resin on the substrate 10 while rolling the applied photosensitive resin.

The nano-imprinting unit 40 may form a pattern on the photosensitive layer formed by the photosensitive layer forming unit 20. A pattern roll 41, on which a designated pattern may be engraved, may be configured to press the liquid photosensitive resin having fluidity. Ultraviolet rays may be irradiated onto the liquid photosensitive resin to harden the liquid photosensitive resin, thus forming the pattern on the photosensitive layer. The nano-imprinting unit 40 may include the pattern roll 41, a nip roll 42, and an ultraviolet ray irradiation unit 43. The nip roll 42 may adjust an interval with the pattern roll 41, thus adjusting the relative pressure, which is applied to the photosensitive layer of the substrate 10 by the pattern roll 41. Further, the ultraviolet ray irradiation unit 43 may irradiate ultraviolet rays onto the photosensitive layer of the substrate 10, to which the pattern may be transferred, to harden the photosensitive layer.

The removing unit 50 may include an etching unit 51 to etch the photosensitive layer of the substrate 10, a washing unit 52 to wash an etchant, and a drying unit 53 to dry the photosensitive layer after washing. The etching unit 51, the washing unit 52, and the drying unit 53 are operated by a known technique, and thus a detailed description of respective functions and operations thereof will be omitted.

The substrate 10, in accordance with the example embodiment of the present invention, may be made of a film type base material having flexibility, for example, a polyimide or polyethylene terephthalate (PET). However, this flexible substrate 10 may be distorted from the normal transfer route due to disturbance. If an alignment error is generated between the substrate 10 and the pattern roll 41 before the substrate 10 passes through the nano-imprinting unit 40, a pattern may be formed at a wrong position of the substrate 10. Thus, in accordance with the example embodiment of the general inventive concept illustrated in FIG. 1, an aligning unit 30 is provided to correct an alignment error before the substrate 10 passes through the nano-imprinting unit 40 so as to prevent or reduce the generation of the alignment error between the substrate 10 and the pattern roll 41.

The aligning unit 30 may include a substrate alignment apparatus 31. Before the configuration of the substrate alignment apparatus 31 is described, the alignment in the roll to roll process will be described. The alignment in the roll to roll process is generally divided into an alignment in a substrate progressing direction, for example, a machine direction (hereinafter, referred to as a MD), and an alignment in a direction crossing the substrate progressing direction, for example, a cross machine direction (hereinafter, referred to as a CMD).

Methods and apparatuses of performing coarse and fine alignment in the MD and the CMD are provided. Coarse alignment is carried out when a relatively large alignment error is generated. Fine alignment is carried out when a relatively small alignment error is generated. For clarity, an apparatus and a process for coarse alignment will be described first, and then, the fine alignment will be described in detail.

Figure 2:
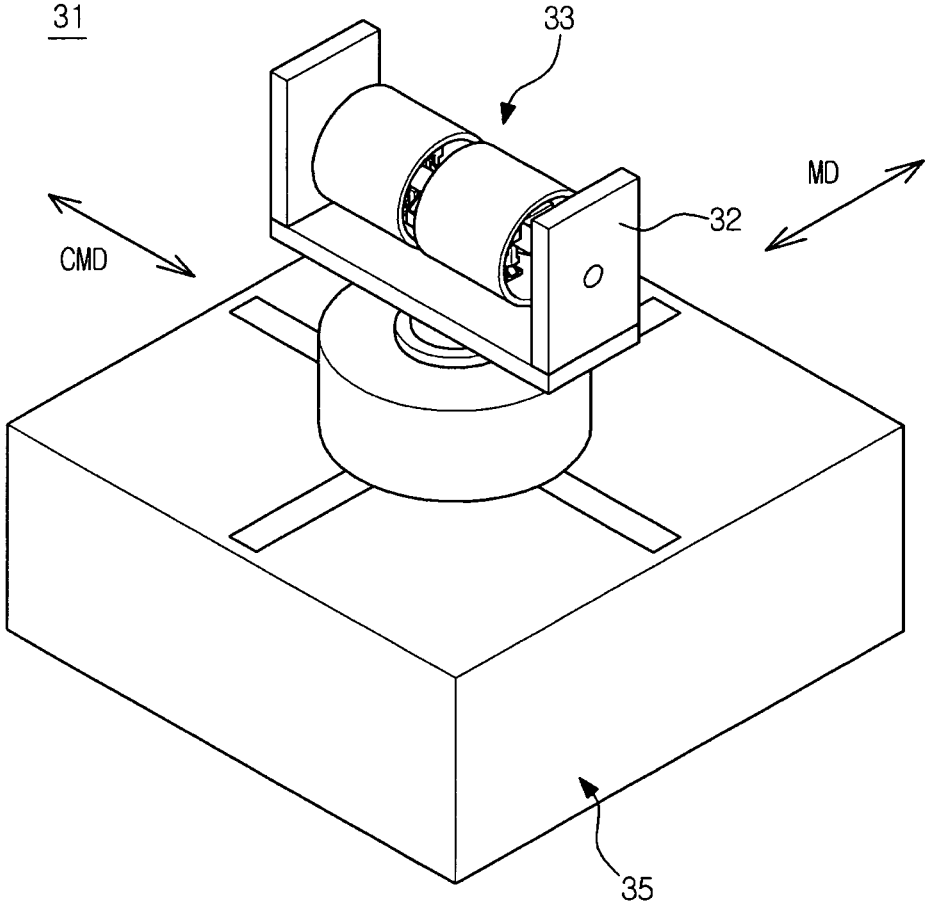
FIG. 2 is a view illustrating a coarse alignment of a substrate alignment apparatus in accordance with the example embodiment of the present invention.

FIG. 2 is a view illustrating the coarse alignment of the substrate alignment apparatus in accordance with the example embodiment of the present invention.

As shown in FIG. 2, the substrate alignment apparatus 31, in accordance with the example embodiment of the present invention, may include a frame 32 and a roller unit 33 rotatably fixed to the frame 32. The substrate 10 may be supported by the roller unit 33.

The substrate alignment apparatus 31 may further include a stage 35 installed below the frame 32 which may be configured to move the frame 32. The stage 35 may be operated when the coarse alignment is performed. In a case where an alignment error between the substrate 10 and the pattern roll 41 is relatively large, a relatively large movement amount may be required to reduce the alignment error between the substrate 10 and the pattern roll 41. The stage 35 may move the frame 32 in the MD or the CMD such that the substrate 10 can be aligned with the pattern roll 41.

Further, the roller unit 33 may be moved on the frame 32 to reduce the alignment error between the substrate 10 and the pattern roll 41. For example, a separate device may be installed between the roller unit 33 and the frame 32 to move the roller unit 33 in the MD or the CMD such that the substrate 10 may be aligned with the pattern roll 41. A method, in which the frame 32 and/or the roller unit 33 may be moved to reduce the alignment error between the substrate 10 and the pattern roll 31 when a relatively large movement amount is required, is referred to as a coarse alignment.

The frame 32 and the roller unit 33 may have a relatively large weight, and thus may have a relatively low movement speed. Accordingly, a relatively long time may be required to remove the alignment error between the substrate 10 and the pattern roll 41. Moreover, a driving motor having a relatively high power may be required to move the frame 32 and the roller unit 33 and finely controlling this driving motor may be difficult.

Figure 3:
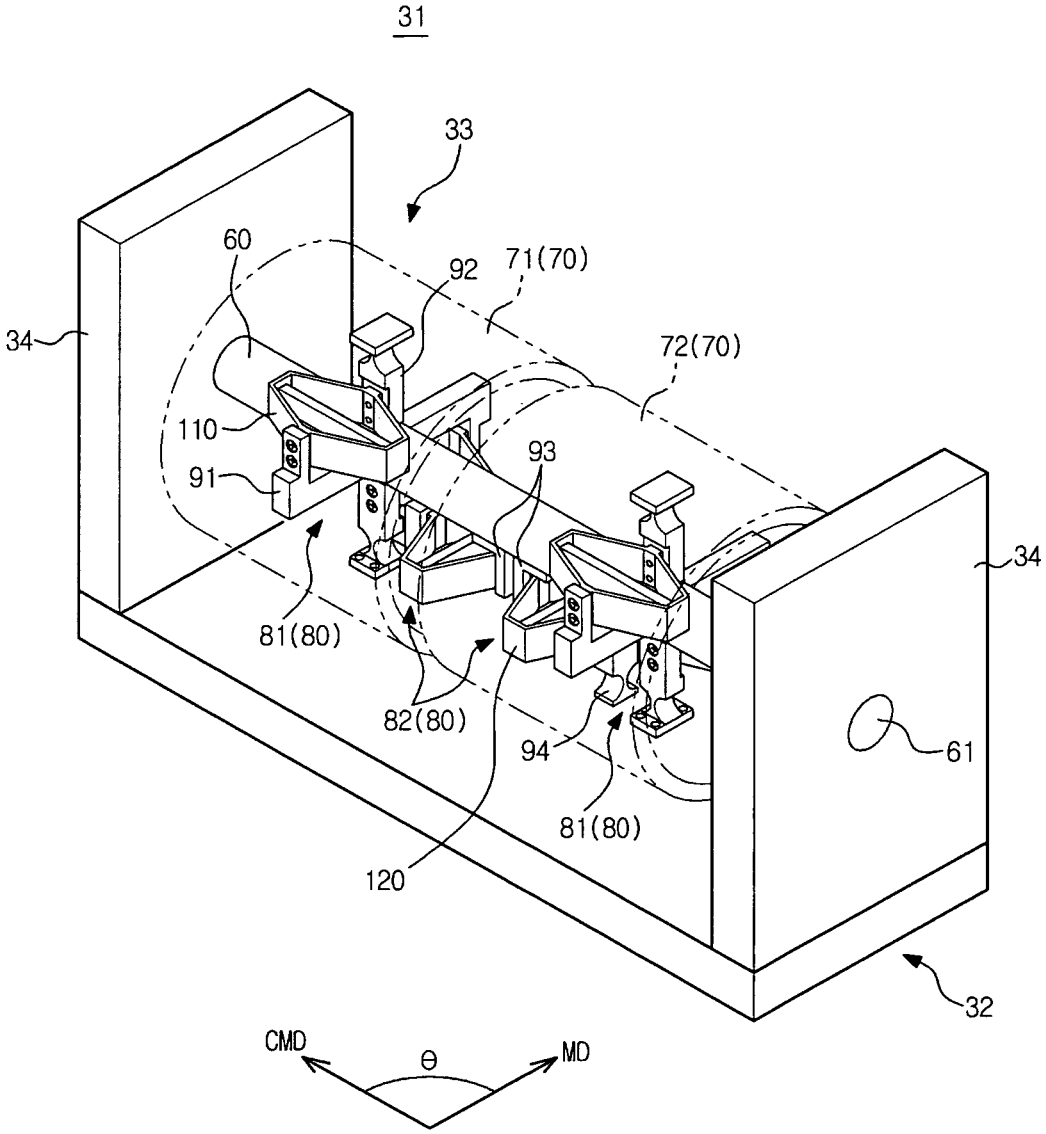
FIG. 3 is a view illustrating a fine alignment of the substrate alignment apparatus in accordance with the example embodiment of the present invention.

FIG. 3 is a view illustrating an apparatus that may be used for fine alignment in accordance with the example embodiment of the present invention. As shown in FIG. 3, the substrate alignment apparatus 31 in accordance with the example embodiment of the present invention may include the frame 32 and the roller unit 33. The roller unit 33 may include a main roller 60 rotatably fixed to the frame 32. The substrate alignment apparatus may also include subsidiary rollers 70 that may be fixed to the main roller 60. The subsidiary rollers 70 may be configured to move relative to the main roller 60.

The main roller 60 may be disposed along a longitudinal direction of the frame 32, and both ends of a rotary shaft 61 of the main roller 60 may be inserted into both side walls 34 of the frame 32. The main roller 60 may be driven by an AC motor or a DC motor.

The subsidiary rollers 70 may be installed such that the subsidiary rollers 70 may move relative to the main roller 60 via the variable devices 80. Because the variable devices 80 may move the subsidiary rollers 70 against the main roller 60 in the MD or the CMD, the substrate 10 may move in the MD or the CMD. FIG. 3 illustrates two subsidiary rollers 70 installed on the main roller 60. When a first subsidiary roller 71 installed at the left is stopped and a second subsidiary roller 72 installed at the right is rotated, the substrate 10 placed on the subsidiary rollers 70 is rotated. The rotating direction of the substrate 10 becomes in the range of an included angle (θ) between the MD and the CMD.

The subsidiary rollers 70 are subordinated to the main roller 60 and thus move together with the movement of the main roller 60, but are moved independently of the main roller 60 when the variable devices 80 are operated.

Hereinafter, the relative movement of the subsidiary rollers 70 to the main roller 60 through the variable devices 80 will be described in detail.

Figure 4:
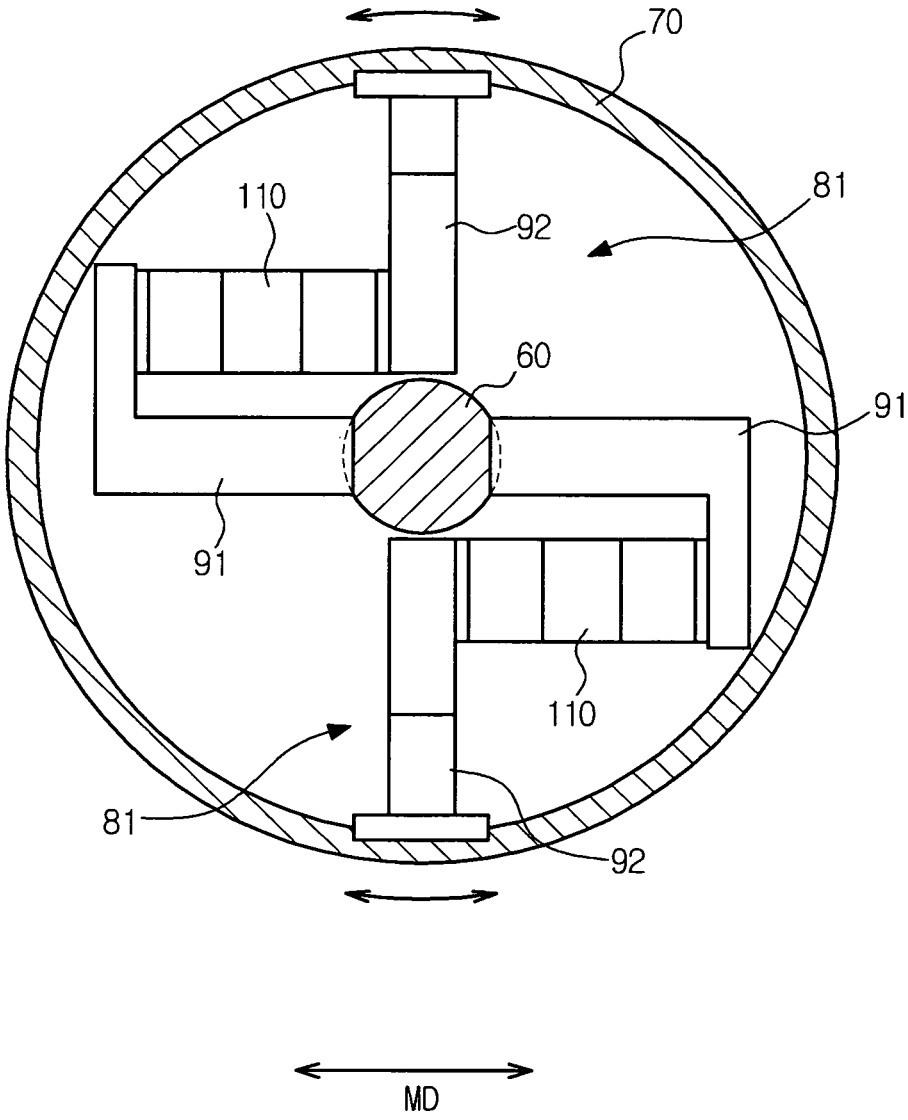
FIG. 4 is a view illustrating a first variable device in accordance with the example embodiment of the present invention.

FIG. 4 is a view illustrating a first variable device in accordance with the example embodiment of the present invention.

As shown in FIGS. 3 and 4, when a first variable device 81 in accordance with the example embodiment of the present invention rotates the subsidiary roller 70 in a direction crossing the longitudinal direction of the main roller 60, the substrate 10 moves in the MD.

The first variable device 81 may include first pressure members 91 connected to the main roller 60, second pressure members 92 connected to the subsidiary roller 70, and first variable members 110 respectively connecting the first pressure members 91 and the second pressure members 92. The first variable members 110 may be characterized in that their length is expanded or contracted in any one direction, and the installing direction of the first variable members 110 crosses the longitudinal direction of the main roller 60. The installing direction of the first variable members 110 means the expanding or contracting direction of the first variable members 110.

The first variable members 110 may be installed in a direction crossing the longitudinal direction of the main roller 60, and thus may be expanded or contracted in the direction crossing the longitudinal direction of the main roller 60. With reference to FIG. 4, where the first variable members 110 are expanded to press the first pressure members 91 and the second pressure members 92, the distance between second pressure members 92 and the first pressure members 91 is gradually increased, and the subsidiary roller 70 connected with the second pressure members 92 is rotated relative to the main roller 60 in a designated direction. Where the first variable members 110 are contracted, the distance between the second pressure members 92 and the first pressure members 91 is gradually decreased, and the subsidiary roller 70 connected with the second pressure members 92 is rotated relative to the main roller 60 in the opposite direction. The substrate 10 may be supported by the subsidiary roller 70, and thus may reciprocate in the MD according to the relative movement of the subsidiary roller 70. Therefore, where an alignment error in the MD between the substrate 10 and the pattern roll 41 is generated, removing or reducing the alignment error in the MD direction by rotating the subsidiary rollers 70 relative to the main roller 60 may be possible. This will be described in detail later.

Figure 5:
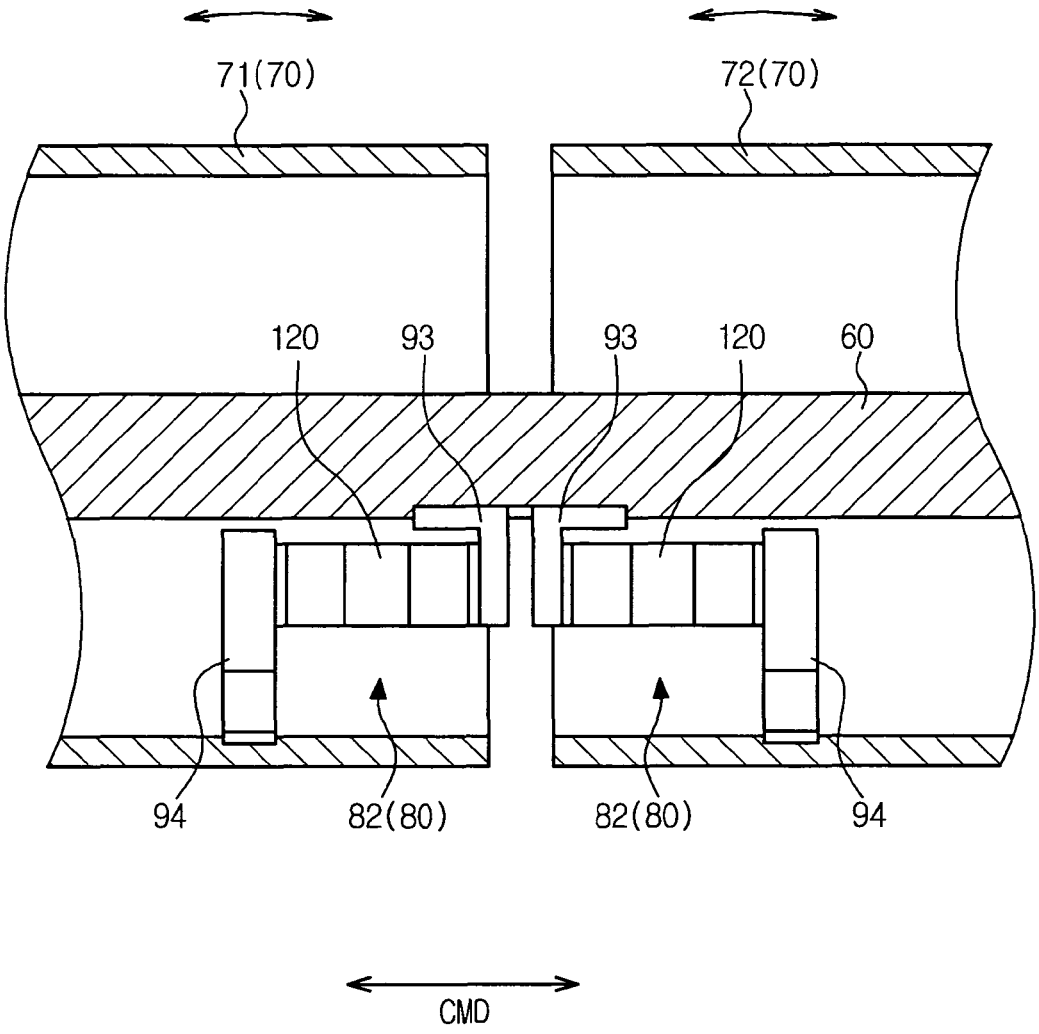
FIG. 5 is a view illustrating a second variable device in accordance with the example embodiment of the present invention.

FIG. 5 is a view illustrating a second variable device in accordance with the example embodiment of the present invention.

As shown in FIGS. 3 and 5, when a second variable device 82 in accordance with the example embodiment of the present invention moves or translates the subsidiary roller 70 in the longitudinal direction of the main roller 60, the substrate 10 may move in the CMD.

The second variable device 82 may include third pressure members 93 connected to the main roller 60, fourth pressure members 94 connected to the subsidiary roller 70, and second variable members 120 respectively connecting the third pressure members 93 and the fourth pressure members 94. The second variable members 120 may be characterized in that their length is expanded or contracted in any one direction, and the installing direction of the second variable members 120 may be the longitudinal direction of the main roller 60. The installing direction of the second variable members 120 means the expanding or contracting direction of the second variable members 120.

The second variable members 120 may be installed in the longitudinal direction of the main roller 60, and thus may be expanded or contracted in the longitudinal direction of the main roller 60. With reference to FIG. 5, where the second variable members 120 are expanded to press the third pressure members 93 and the fourth pressure members 94, the distance between the third pressure members 93 and the fourth pressure members 94 may be increased and the subsidiary roller 70 connected with the fourth pressure members 94 may be moved relative to the main roller 60 in a designated direction. Where the second variable members 120 are contracted, the distance between the fourth pressure members 94 and the third pressure members 93 may be decreased and the subsidiary roller 70 connected with the fourth pressure members 94 may be moved relative to the main roller 60 in an opposite direction. The substrate 10 may be supported by the subsidiary roller 70, and thus, may reciprocate in the CMD according to the relative movement of the subsidiary roller 70. Therefore, where an alignment error in the CMD between the substrate 10 and the pattern roll 41 is generated, removing or reducing the alignment error in the CMD direction by moving the subsidiary rollers 70 relative to the main roller 60 may be possible. This will be described in detail later.

Figure 6A:
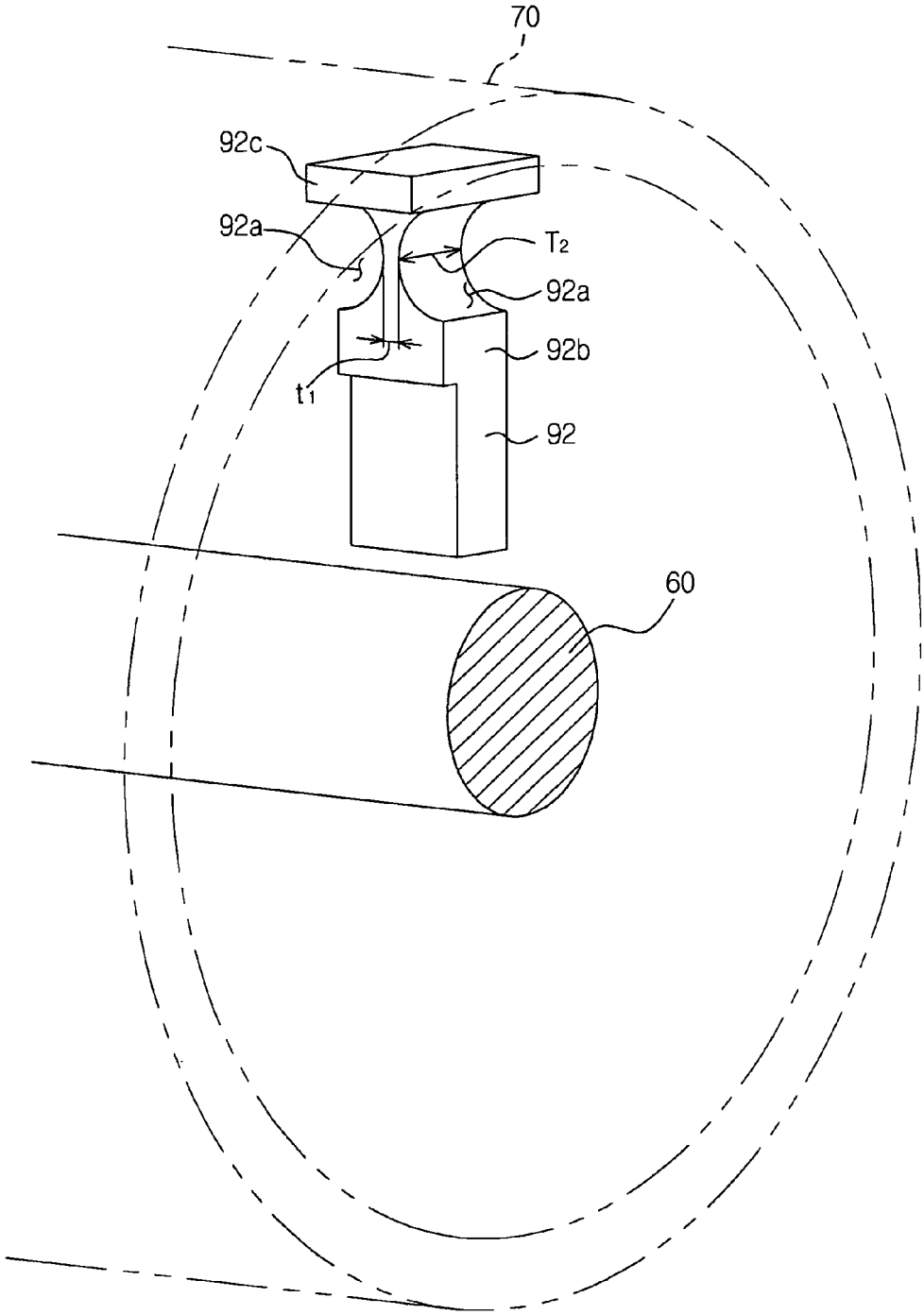
FIG. 6A is a view illustrating a second pressure member in accordance with an example embodiment of the present invention.
Figure 7A:
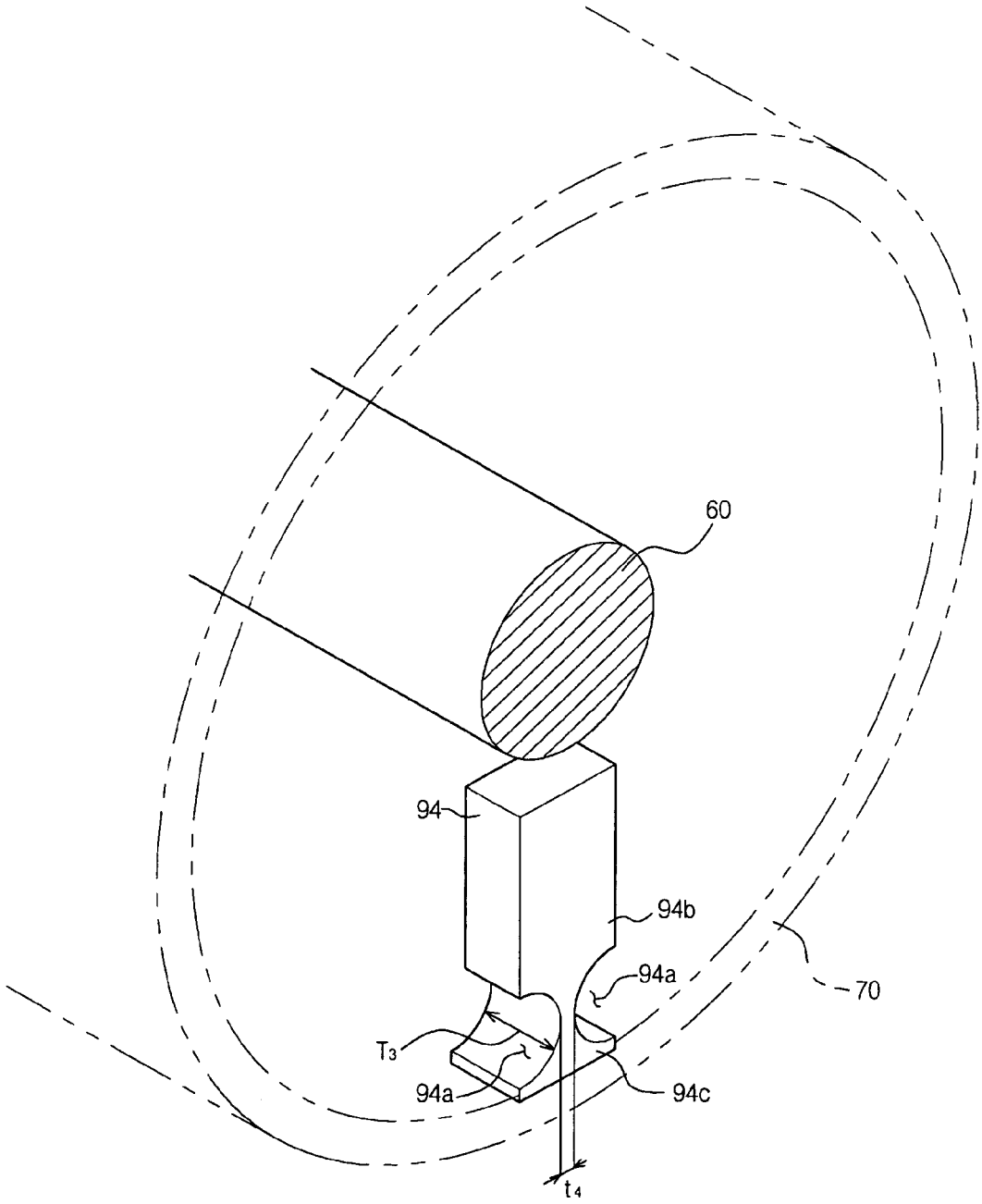
FIG. 7A is a view illustrating a fourth pressure member in accordance with an example embodiment of the present invention.

FIG. 6A is a view illustrating the second pressure member in accordance with the example embodiment of the present invention, and FIG. 7A is a view illustrating the fourth pressure member in accordance with the example embodiment of the present invention.

With reference to FIGS. 3 and 7, the rotating direction of the subsidiary rollers 70 relative to the main roller 60 to remove the alignment error in the MD through the substrate alignment apparatus 31, as shown in FIGS. 3 and 4, may be the direction crossing the longitudinal direction of the main roller 60. Similarly, the movement of the subsidiary rollers 70 relative to the main roller 60 to remove the alignment error in the CMD through the substrate alignment apparatus 31, as shown in FIGS. 3 and 5, may be the longitudinal direction of the main roller 60. That is, the subsidiary rollers 70 can be moved relative to the main roller 60 in the longitudinal direction of the main roller 60 and rotated in a direction crossing the longitudinal direction of the main roller 60.

Therefore, each of the second pressure members 92 connected to the subsidiary rollers 70 may be formed, as shown in FIG. 6A, and each of the fourth pressure members 94 connected to the subsidiary rollers 70 may be formed, as shown in FIG. 7A.

FIG. 6A illustrates indentations 92*a* of the second pressure member 92 that may be formed in the longitudinal direction of the main roller 60. That is, a portion of the second pressure member 92 having the indentations 92*a* may have a thickness ($t_1$) in the longitudinal direction of the main roller 60, which is relatively small, and may have a thickness ($T_2$) in the direction crossing the longitudinal direction of the main roller 60, which is relatively large. Therefore, where the second pressure member 92 is pressed in the longitudinal direction of the main roller 60, the second pressure member 92 may be bent in the longitudinal direction of the main roller 60. However, if the second pressure member 92 is pressed in the direction crossing the longitudinal direction of the main roller 60, the second pressure member 92 remains relatively undeformed in the direction crossing the longitudinal direction of the main roller 60.

Figure 6B:
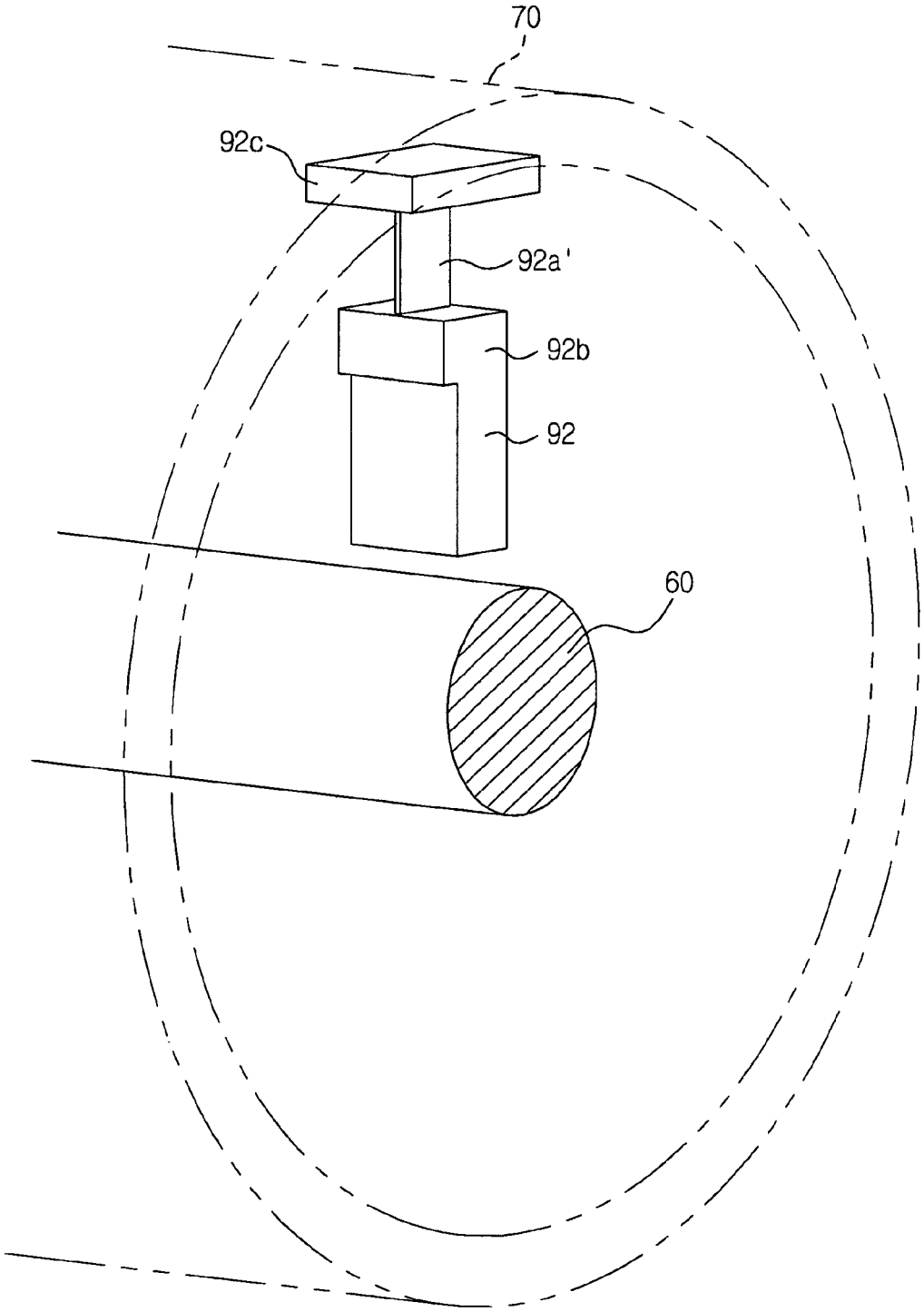
FIG. 6B is a view illustrating a second pressure member in accordance with an example embodiment of the present invention.

In lieu of indentations 92*a*, the second pressure member 92 may be formed with a plate spring 92*a*' between a body portion 92*b* of the second pressure member 92 and a head portion 92*c* of the second pressure member 92 as shown in FIG. 6B. The plate spring 92*a*' would allow the second pressure member 92 to bend in the longitudinal direction of the main roller 60.

FIG. 7A illustrates indentations 94*a* of the fourth pressure member 94 that may be formed in the direction crossing the longitudinal direction of the main roller 60. That is, a portion of the second pressure member 94 having the indentations 94*a* may have a thickness ($T_3$) in the longitudinal direction of the main roller 60, which may be relatively large, and a thickness ($t_4$) in the direction crossing the longitudinal direction of the main roller 60, which may be relatively small. Therefore, where the fourth pressure member 94 is pressed in the longitudinal direction of the main roller 60, the fourth pressure member 94 remains relatively undeformed in the longitudinal direction of the main roller 60. However, where the fourth pressure member 94 is pressed in the direction crossing the longitudinal direction of the main roller 60, the fourth pressure member 94 may be bent in the direction crossing the longitudinal direction of the main roller 60.

Figure 7B:
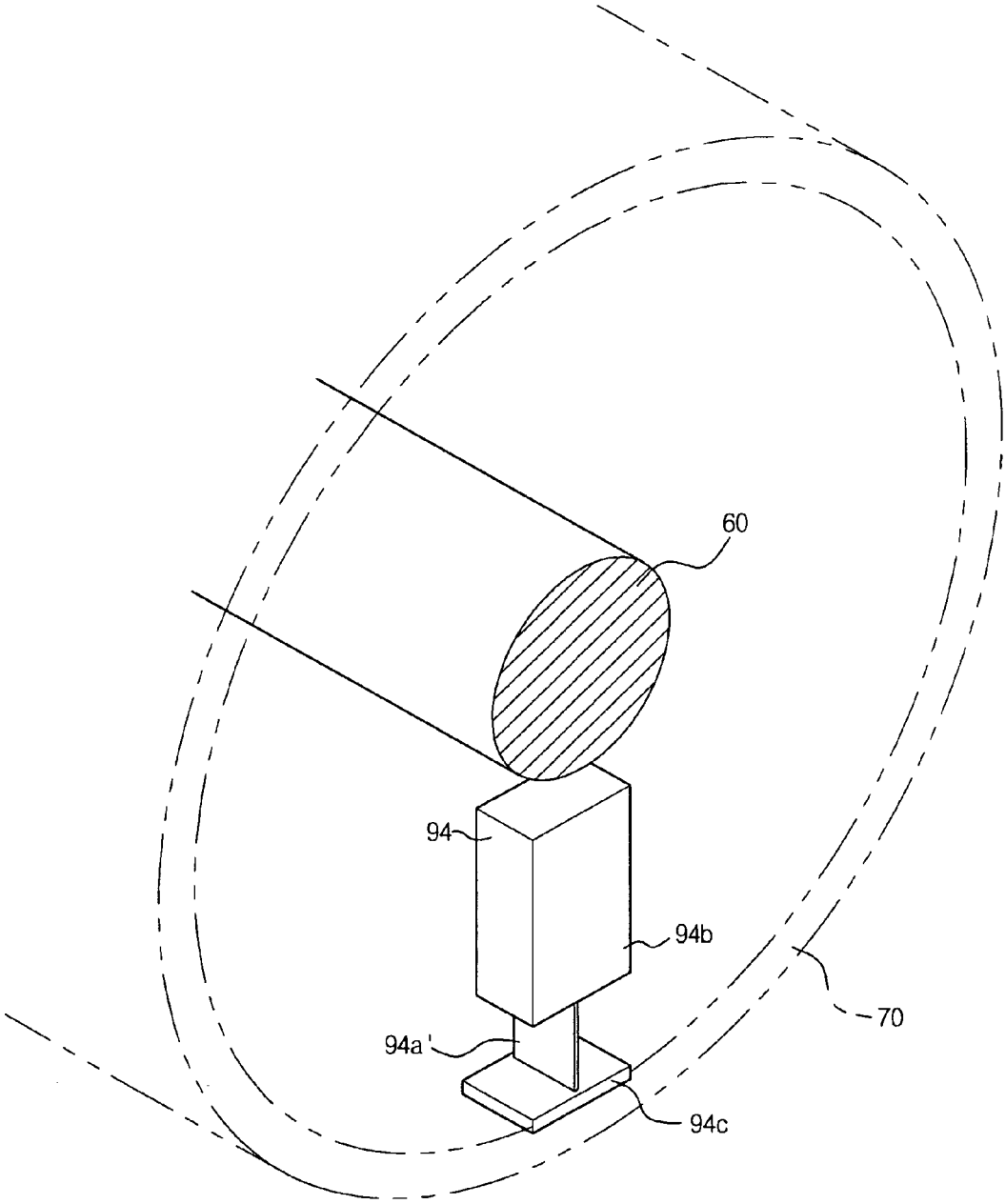
FIG. 7B is a view illustrating a fourth pressure member in accordance with an example embodiment of the present invention.

In lieu of indentations 94*a*, the fourth pressure member 94 may be formed with a plate spring 94*a*' between a body portion 94*b* of the fourth pressure member 94 and a head portion 94*c* of the fourth pressure member 94 as shown in FIG. 7B. The plate spring 94*a*' would allow the fourth pressure member 94 to bend in the direction crossing the longitudinal direction of the main roller 60.

Where the first variable device 81 presses the first pressure members 91 and the second pressure members 92 in the direction crossing the longitudinal direction of the main roller 60, the second pressure members 92 connected with the subsidiary roller 70 are relatively undeformed in the direction crossing the longitudinal direction of the main roller 60, and thus, the subsidiary roller 70 receives force transmitted through the second pressure members 92. Simultaneously, the fourth pressure members 94 connected to the subsidiary roller 70 are bent in the direction crossing the longitudinal direction of the main roller 60, and thus, the subsidiary roller 70 may be rotated relative to the main roller 60 as much as the bending of the fourth pressure members 94 permits by the force transmitted through the second pressure members 92.

Where the second variable device 82 presses the third pressure members 93 and the fourth pressure members 94 in the longitudinal direction of the main roller 60, the fourth pressure members 94 connected with the subsidiary roller 70 are relatively undeformed in the longitudinal direction of the main roller 60, and thus, the subsidiary roller 70 may receive a force transmitted through the fourth pressure members 94. Simultaneously, the second pressure members 92 connected to the subsidiary roller 70 are bent in the longitudinal direction of the main roller 60, and thus, the subsidiary roller 70 may be moved relative to the main roller 60 as much as the bending of the second pressure members 92 permits by the force transmitted through the fourth pressure members 94.

Figure 8:
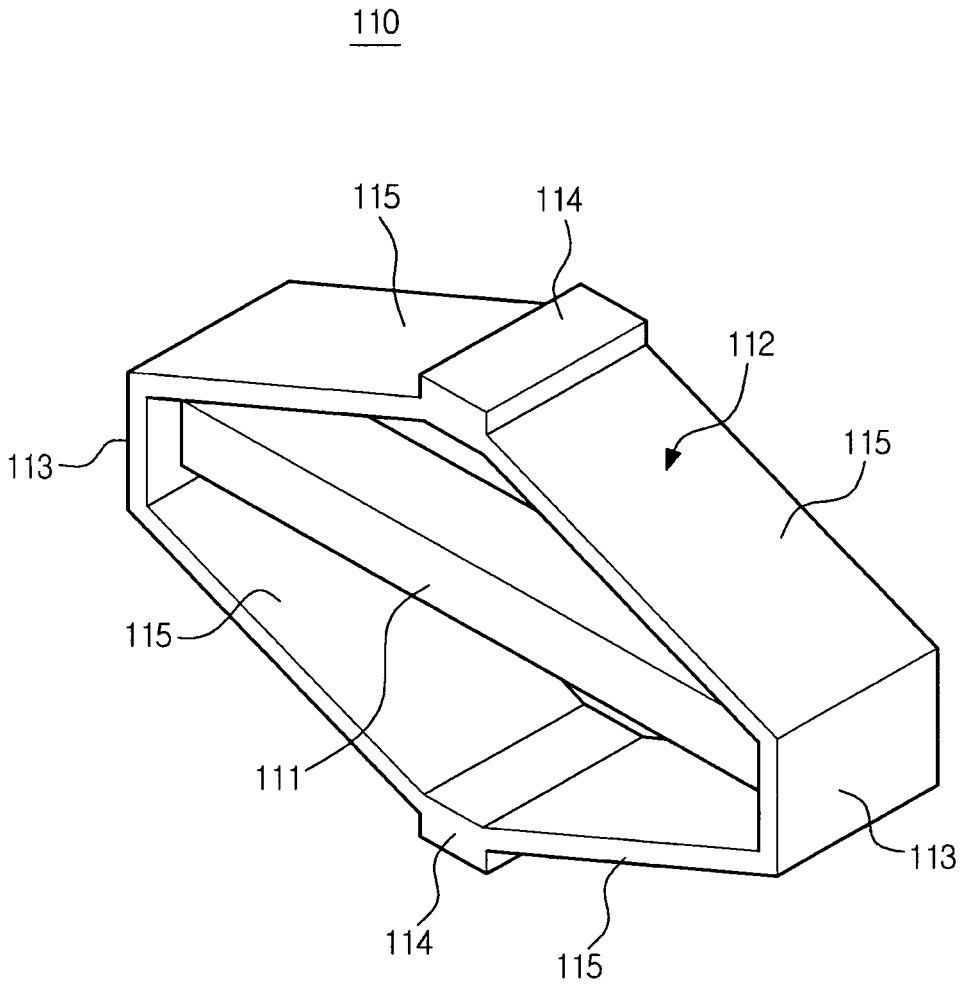
FIG. 8 is a view illustrating a first variable member and a second variable member in accordance with the example embodiment of the present invention.

FIG. 8 is a view illustrating the first variable member 110 and the second variable member 120 in accordance with the example embodiment of the present invention.

With reference to FIG. 3, the first variable members 110 are installed in the direction crossing the longitudinal direction of the main roller 60, and the second variable members 120 are installed in the longitudinal direction of the main roller 60. As described above, the installing directions of the first variable members 110 and the second variable members 120 correspond to the expanding or contracting directions of the first variable members 110 and the second variable members 120. The first variable members 110 and the second variable members 120 may have the same structure except that the installing directions of the first variable members 110 and the second variable members 120 are different. Thus, only the first variable members 110 will be described.

As shown in FIG. 8, the first variable member 110 in accordance with the example embodiment of the present invention may include a piezoelectric element 111 and an amplifier 112 surrounding the piezoelectric element 111.

The piezoelectric element 111 is an element, which is electrically polarized when external mechanical deformation is applied to the element. Conversely, where a voltage is applied to the piezoelectric element 111, the length of the piezoelectric element may be increased or decreased. Further, the piezoelectric element 111 may have a high bandwidth, and thus, may be capable of being driven at a high speed. Accordingly, the piezoelectric element 111 may remove, reduce, and/or stabilize an alignment error in a short time.

The amplifier 112 is a unit to amplify the displacement of the piezoelectric element 111. The amplifier 112 may have an approximately hexagonal shape, and may include two symmetric side surfaces 113, two symmetric supports 114, and four oblique sides 115 connecting the side surfaces 113 and the supports 114. Both ends of the piezoelectric element 111 may be respectively connected to the two side surfaces 113. Further, as shown in FIG. 3, any one of the two supports 114 may be connected to the first pressure member 91, and the other one of the two supports 114 may be connected to the second pressure member 92.

Where the length of the piezoelectric element 111 is increased by applying voltage to the piezoelectric element 111, the distance between the two side surfaces 113 may be increased and the distance between the two supports 114 may be decreased. Therefore, the first pressure member 91 and the second pressure member 92 may be brought relatively close to each other. Where the length of the piezoelectric element 111 is decreased by applying a voltage to the piezoelectric element 111, the distance between the two side surfaces 113 may be decreased and the distance between the two supports 114 may be increased. Thereby, the first pressure member 91 and the second pressure member 92 may be space pushed apart from each other. The rotation of the subsidiary roller 70 relative to the main roller 60 according to the increase or decrease of the interval between the first pressure member 91 and the second pressure member 92 was described above.

Hereinafter, the operation of the substrate alignment apparatus 31 in accordance with the example embodiment of the present invention will be described.

With reference to FIG. 1, the substrate 10 may be generally divided into a display region and a non-display region. A plurality of gate lines and a plurality data lines, which intersect each other, may be arranged in the display region, and thin film transistors may be respectively provided at the intersections. Pads to apply a driving signal to the gate lines and the data lines may be formed in the non-display region. Alignment marks may be formed in the non-display region of the substrate 10. An error of the alignment mark may be generated during a patterning process of the alignment marks or due to deformation of the substrate 10 caused by heat and/or moisture. The alignment error between the substrate 10 and the pattern roll 41 may be removed using the alignment marks.

For example, the substrate alignment apparatus 31 may include an error measuring unit 36, which may sense and measure a variation of the size of the substrate 10 by checking the positions of the alignment marks. The substrate alignment apparatus 31 may be configured to output a signal corresponding to the sensed or measured data. For example, the error measuring unit 36 may measure alignment errors of the substrate 10 in the MD and the CMD, and at the included angle (θ) between the MD and the CMD by measuring a distance between the alignment marks. By way of example only, the error measuring unit 36 may employ a CCD camera to check the positions and displacements of the alignment marks.

The substrate alignment apparatus 31 may further include a control unit 37, which may output voltages to the piezoelectric elements 111 according to the alignment errors of the substrate 10 in the MD and the CMD, and at the included angle (θ) between the MD and the CMD.

Figure 9:
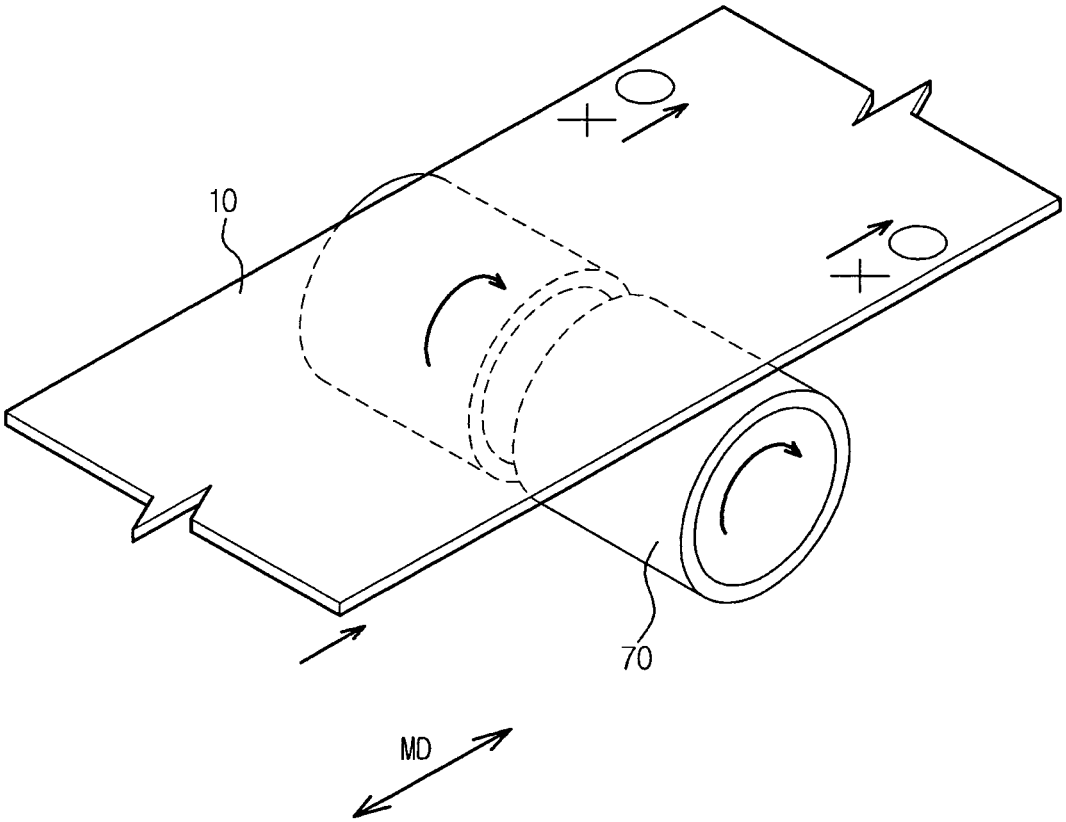
FIG. 9 is a view illustrating the generation of an alignment error of a substrate in a machine direction (MD) in accordance with the example embodiment of the present invention.

FIG. 9 is a view illustrating the generation of an alignment error of the substrate in the MD in accordance with the example embodiment of the present invention.

As shown in FIG. 9, a mark 'X' patterned on the substrate 10 in accordance with the example embodiment of the present invention represents an alignment mark. Further, a mark 'O' in FIG. 9 represents a pattern mark, which indicates the position of the alignment mark X when an alignment error is not generated. FIG. 9 illustrates the generation of an alignment error of the substrate in the machine direction MD. The error measuring unit 36 may measure an error between the alignment marks X and the pattern marks O using, for example, a CCD camera. The error measuring unit 36 may also be configured to output a signal corresponding to the measured error.

The control unit 37 may receive the signal of the error measuring unit 36 and apply a voltage to the piezoelectric elements 111 of the first variable devices 81. When the voltage is applied to the piezoelectric elements 111, the first variable devices 81 rotates the subsidiary rollers 70 in the MD relative to the main roller 60. Thereby, the substrate 10 supported by the subsidiary rollers 70 progresses in the MD, and the alignment marks X and the pattern marks O coincide with each other, and thus, the alignment error therebetween is reduced or removed.

However, where the alignment error between the alignment marks X and the pattern marks O is relatively large, and thus a comparatively large movement amount is required, the frame 32 may be moved in the MD using the stage 35.

Figure 10:
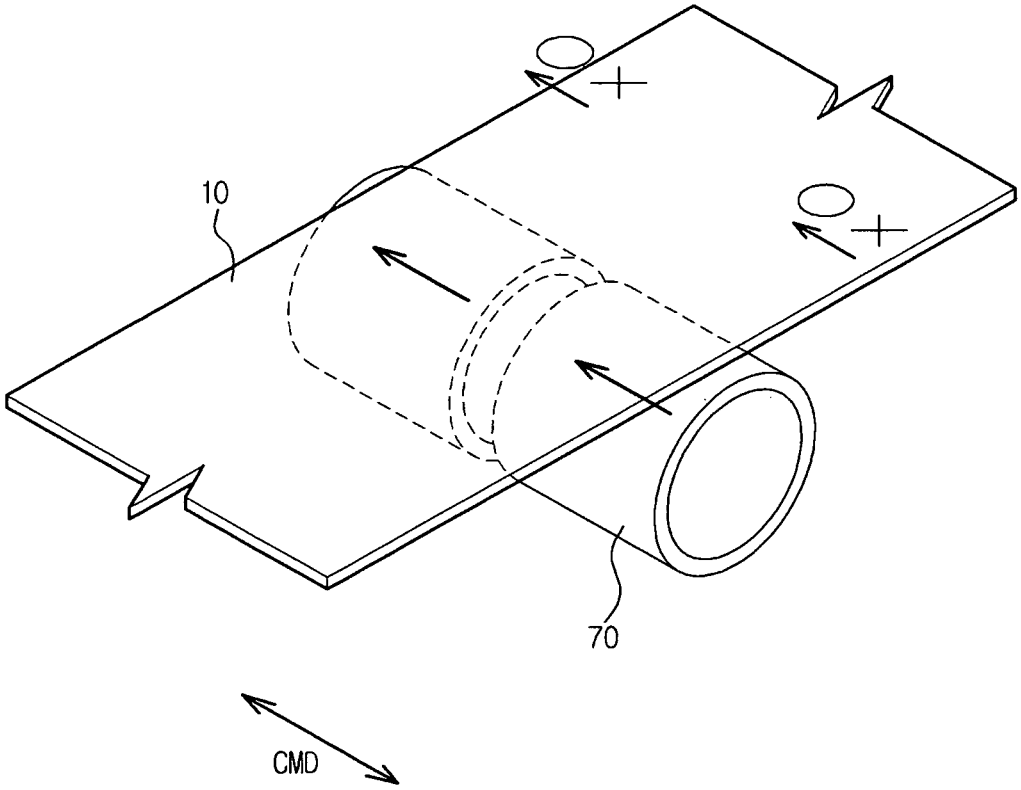
FIG. 10 is a view illustrating the generation of an alignment error of the substrate in a cross machine direction (CMD) in accordance with the example embodiment of the present invention.

FIG. 10 is a view illustrating the generation of an alignment error of the substrate in the CMD in accordance with the example embodiment of the present invention.

As shown in FIG. 10, in consideration of the positions of the alignment marks X and the pattern marks O, an alignment error of the substrate 10 in the direction crossing machine direction CMD, may be generated. The error measuring unit 36 may measure an error between the alignment marks X and the pattern marks O, and may output a signal to the control unit 37. The control unit 37 may apply a voltage to the piezoelectric elements 111 of the second variable devices 82 so as to move the substrate 10 in the CMD. When the voltage is applied to the piezoelectric elements 111, the second variable devices 82 move the subsidiary rollers 70 in the CMD relative to the main roller 60. Therefore, the substrate 10 supported by the subsidiary rollers 70 may move in the CMD, and the alignment marks X and the pattern marks O may coincide with each other and thus reducing or removing the alignment error there between.

Where the alignment error between the alignment marks X and the pattern marks O is relatively large, and thus a comparatively large movement amount is required, the frame 32 may be moved in the CMD using the stage 35.

Figure 11:
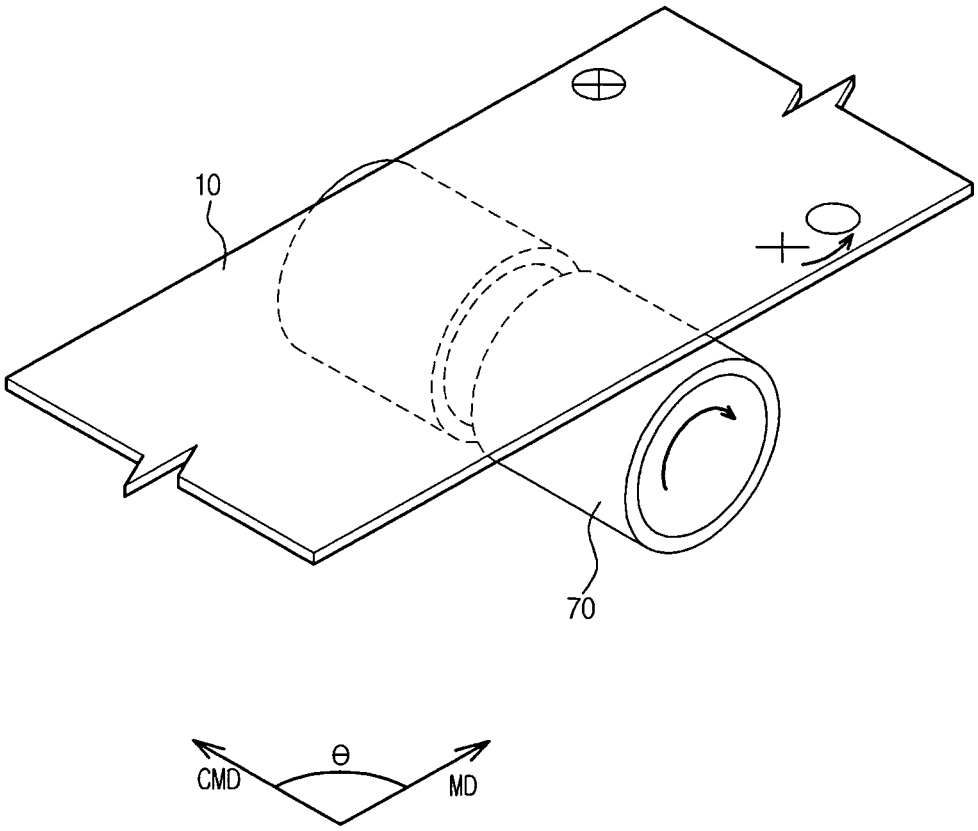
FIG. 11 is a view illustrating the generation of an alignment error of the substrate at an angle between the MD and the CMD in accordance with the example embodiment of the present invention.

FIG. 11 is a view illustrating the generation of an alignment error of the substrate at an angle between the MD and the CMD in accordance with the example embodiment of the present invention.

As shown in FIG. 11, the alignment mark X and the pattern mark O at the left side may coincide with each other, but the alignment mark X and the pattern mark O at the right side may not coincide with each other. This represents an alignment error of the substrate 10 caused by the rotation of the substrate 10 at the angle (θ) between the MD and the CMD. The error measuring unit 36 may measure an error between the alignment mark X and the pattern mark O and output a signal to the control unit 37.

The control unit 37 may not apply voltage to the piezoelectric elements 111 of the first variable device 81 provided at the first subsidiary roller 71 but may apply a voltage to the piezoelectric elements 111 of the first variable device 81 provided at the second subsidiary roller 72, as shown in FIG. 3, so as to rotate the substrate at the angle (θ) between the MD and the CMD. In example embodiments, the second subsidiary roller 72 may be rotated relative to the main roller 60 by the first variable device 81. Because the substrate 10 may be supported by the first subsidiary roller 71 and the second subsidiary roller 72, where the first subsidiary roller 71 is stopped and the second subsidiary roller 72 is rotated, the substrate 10 may be rotated at the angle (θ) between the MD and the CMD. Thereby, the alignment mark X and the pattern mark O may coincide with each other and thus the alignment error therebetween is reduced or removed.

In a case where the alignment error between the alignment mark X and the pattern mark O is relatively large and thus a relatively large movement amount is required, the frame 32 may be rotated at the angle (θ) between the MD and the CMD using the stage 35.

As described above, the substrate alignment apparatus in accordance with the example embodiment of the present invention may increase alignment accuracy through fine alignment, thus be capable of producing a LCD or a OLED using a roll to roll process.

The substrate alignment apparatus may use piezoelectric elements having a rapid response speed, thus being capable of removing an alignment error at a high speed.

The substrate alignment apparatus may be used to remove alignment errors generated in a substrate transfer process as well as the roll to roll process, thus performing the process more accurately.

Although an example embodiment of the invention has been shown and described, it would be appreciated by those skilled in the art that changes may be made in this embodiment without departing from the principles and spirit of the invention, the scope of which is defined in the claims and their equivalents.

What is claimed is:

1. A substrate alignment apparatus, comprising:

a frame;

a roller unit rotatably fixed to the frame to support a substrate, the roller unit includes a main roller, and at least one subsidiary roller disposed co-axially with the main roller, and the at least one subsidiary roller can move independently relative to the main roller to align the substrate; and variable devices between the main roller and the at least one subsidiary roller to move the at least one subsidiary roller relative to the main roller, wherein the variable devices include a first variable device configured to press the at least one subsidiary roller in a direction crossing a longitudinal direction of the main roller, and a second variable device configured to press the at least one subsidiary roller in the longitudinal direction of the main roller, wherein the first variable device includes a first pressure member connected to the main roller, a second pressure member connected to the at least one subsidiary roller, and a first variable member connecting the first pressure member and the second pressure member, wherein a length of the first variable member is adjustable in the direction crossing the longitudinal direction of the main roller, and wherein the first variable member includes a piezoelectric element.

2. The substrate alignment apparatus according to claim 1, wherein the second pressure member includes an indentation such that the second pressure member can bend in the longitudinal direction of the main roller.

3. The substrate alignment apparatus according to claim 1, wherein the second variable device includes a third pressure member connected to the main roller, a fourth pressure member connected to the at least one subsidiary roller, and a second variable member connecting the third pressure member and the fourth pressure member, and a length of the second variable member is adjustable in the longitudinal direction of the main roller.

4. The substrate alignment apparatus according to claim 3, wherein the fourth pressure member includes an indentation such that the fourth pressure member can bend in the direction crossing the longitudinal direction of the main roller.

5. The substrate alignment apparatus according to claim 1, wherein the at least one subsidiary roller is a plurality of subsidiary rollers installed in a longitudinal direction of the main roller, and each of the subsidiary rollers of the plurality of subsidiary rollers is fixed to the main roller such that each of subsidiary rollers of the plurality of the subsidiary rollers can move relative to the main roller.

6. The substrate alignment apparatus according to claim 1, further comprising:

a stage configured to move the frame in a progressing direction of the substrate or a direction crossing the progressing direction of the substrate or to rotate the frame.

7. The substrate alignment apparatus according to claim 1, wherein the direction crossing the longitudinal direction of the main roller is a progressing direction of the substrate.

8. The substrate alignment apparatus according to claim 7, wherein the second variable device includes a second variable member between the main roller and the at least one subsidiary roller, and a length of the second variable member is variable in the longitudinal direction of the main roller.

9. A substrate alignment apparatus, comprising:

a frame;

a roller unit rotatable fixed to the frame to support a substrate, the roller unit includes a main roller, and at least one subsidiary roller disposed co-axially with the main roller, and the at least one subsidiary roller can move independently relative to the main roller to align the substrate; and variable devices between the main roller and the at least one subsidiary roller to move the at least one subsidiary roller relative to the main roller, wherein the variable devices include a first variable device configured to press the at least one subsidiary roller in a direction crossing a longitudinal direction of the main roller, and a second variable device configured to press the at least one subsidiary roller in the longitudinal direction of the main roller, wherein the first variable device includes a first pressure member connected to the main roller, a second pressure member connected to the at least one subsidiary roller, and a first variable member connecting the first pressure member and the second pressure member, wherein a length of the first variable member is adjustable in the direction crossing the longitudinal direction of the main roller, and wherein the second pressure member includes a plate spring such that the second pressure member can bend in the longitudinal direction of the main roller.

10. A substrate alignment apparatus, comprising:

a frame;

a roller unit rotatably fixed to the frame to support a substrate, the roller unit includes a main roller, and at least one subsidiary roller disposed co-axially with the main roller, and the at least one subsidiary roller can move independently relative to the main roller to align the substrate; and variable devices between the main roller and the at least one subsidiary roller to move the at least one subsidiary roller relative to the main roller, wherein the variable devices include a first variable device configured to press the at least one subsidiary roller in a direction crossing a longitudinal direction of the main roller, and a second variable device configured to press the at least one subsidiary roller in the longitudinal direction of the main roller, wherein the second variable device includes a third pressure member connected to the main roller, a fourth pressure member connected to the at least one subsidiary roller, and a second variable member connecting the third pressure member and the fourth pressure member, wherein a length of the second variable member is adjustable in the longitudinal direction of the main roller, and wherein the second variable member includes a piezoelectric element.

11. A substrate alignment apparatus, comprising:

a frame a roller unit rotatably fixed to the frame to support a substrate, the roller unit includes a main roller, and at least one subsidiary roller disposed co-axially with the main roller, and the at least one subsidiary roller can move independently relative to the main roller to align the substrate; and variable devices between the main roller and the at least one subsidiary roller to move the at least one subsidiary roller relative to the main roller, wherein the variable devices include a first variable device configured to press the at least one subsidiary roller in a direction crossing a longitudinal direction of the main roller, and a second variable device configured to press the at least one subsidiary roller in the longitudinal direction of the main roller, wherein the second variable device includes a third pressure member connected to the main roller, a fourth pressure member connected to the at least one subsidiary roller, and a second variable member connecting the third pressure member and the fourth pressure member, wherein a length of the second variable member is adjustable in the longitudinal direction of the main roller, and wherein the second variable member includes a piezoelectric element and an amplifier to amplify a variation of a length of the piezoelectric element.

12. A substrate alignment apparatus, comprising:

a frame;

a roller unit rotatably fixed to the frame to support a substrate, the roller unit includes a main roller, and at least one subsidiary roller disposed co-axially with the main roller, and the at least one subsidiary roller can move independently relative to the main roller to align the substrate; and variable devices between the main roller and the at least one subsidiary roller to move the at least one subsidiary roller relative to the main roller, wherein the variable devices include a first variable device configured to press the at least one subsidiary roller in a direction crossing a longitudinal direction of the main roller, and a second variable device configured to press the at least one subsidiary roller in the longitudinal direction of the main roller, wherein the second variable device includes a third pressure member connected to the main roller, a fourth pressure member connected to the at least one subsidiary roller, and a second variable member connecting the third pressure member and the fourth pressure member, wherein a length of the second variable member is adjustable in the longitudinal direction of the main roller, and wherein the fourth pressure member includes a plate spring such that the fourth pressure member can bend in the direction crossing the longitudinal direction of the main roller.

* * * * *